US006207035B1

(12) United States Patent
Adler et al.

(10) Patent No.: US 6,207,035 B1
(45) Date of Patent: Mar. 27, 2001

(54) METHOD FOR MANUFACTURING A METALLIC COMPOSITE STRIP

(75) Inventors: Udo Adler; Klaus Schleicher, both of Stolberg (DE)

(73) Assignee: Stolberger Metallwerke GmbH & Co. KG, Stolberg (DE)

( * ) Notice: Subject to any disclaimer, the term of this patent is extended or adjusted under 35 U.S.C. 154(b) by 0 days.

(21) Appl. No.: 09/196,684

(22) Filed: Nov. 20, 1998

(30) Foreign Application Priority Data

Nov. 26, 1997 (DE) ..... 197 52 329

(51) Int. Cl.[7] ..... C25D 5/50; C25D 5/10; B05D 3/02; B05D 1/36

(52) U.S. Cl. ..... 205/154; 205/170; 205/176; 205/183; 205/191; 205/228; 205/230; 205/232; 205/225

(58) Field of Search ..... 205/170, 176, 205/183, 184, 191, 225, 228, 230, 232, 154; 427/372.2, 376.8, 405

(56) References Cited

U.S. PATENT DOCUMENTS 4,946,090 * 8/1990 Hepburn ..... 228/121

5,514,261 5/1996 Herklotz et al. ..... 205/238

FOREIGN PATENT DOCUMENTS 8-55521 * 2/1996 (JP) .

* cited by examiner

*Primary Examiner*—Edna Wong
(74) *Attorney, Agent, or Firm*—Kenyon & Kenyon

(57) ABSTRACT

A method for manufacturing a metal composite strip for the production of electrical contact components. A film made of tin or a tin alloy is first applied onto an initial material made of an electrically conductive base material. A film of silver is then deposited thereonto. Copper or a copper alloy is preferably used as the base material. The tin film can be applied in the molten state, and the silver film by electroplating. Furthermore, both the tin film and the silver film can be deposited by electroplating. A further alternative provides for manufacturing the tin film in the molten state and the silver film by cathodic sputtering. The diffusion operations which occur in the coating result in a homogeneous film of a tin-silver alloy. This formation can be assisted by way of a heat treatment of the composite strip.

9 Claims, No Drawings

METHOD FOR MANUFACTURING A METALLIC COMPOSITE STRIP

BACKGROUND OF THE INVENTION

1. Field of the Invention

The invention relates to a method for manufacturing a composite strip, coated with a tin-silver alloy, for producing electrical contact components.

2. Description of Related Art

Tin-silver is a very good contact material. It is characterized principally by its low electrical resistance, its hardness, and its abrasion resistance.

The possibilities for coating an electrically conductive base material with a tin-silver alloy by electroplating are, however, limited. U.S. Pat. No. 5,514,261 discloses in this connection a way to deposit a silver-tin alloy by electroplating from a cyanide-free bath. The bath is prepared using silver as the nitrate or diamine complex, tin as a soluble tin(II) or tin(IV) compound, and mercaptoalkane carboxylic acids and sulfonic acids. Films of silver-tin alloys with a silver content of approximately 20 wt % to 99 wt % can be deposited from this bath.

The silver concentration of a coating manufactured in this manner is relatively high; films with lower silver concentrations cannot be attained. In addition, the film generated by electroplating is finely banded, with a slight microroughness. The film is brittle, and will tolerate only small bending stresses.

SUMMARY OF THE INVENTION

It is the object of the present invention to provide a method which makes possible the manufacture of a high-quality tin-silver coating on an electrically conductive base material.

In accordance with the present invention, these and other objects are achieved by the following process. A film made of tin or a tin alloy is first applied onto a starting material made of an electrically conductive base material. A film of silver is then deposited thereonto. Copper or a copper alloy is preferably used as the base material. The tin film can be applied in the molten state, and the silver film by electroplating. Both the tin film and the silver film can also be deposited by electroplating. A further alternative provides for manufacturing the tin film in the molten state and the silver film by cathodic sputtering. The diffusion operations which occur in the coating result in a homogeneous film of a tin-silver alloy. This formation can be assisted by heat treating the composite strip.

DETAILED DESCRIPTION OF THE INVENTION

The base material is equipped in a first coating step with a coating of tin or a tin alloy. In a second coating step, a silver film is deposited thereonto.

The diffusion processes which then occur result in a tin-silver alloy film. This has improved properties as compared with the initially heterogeneously applied films. The coating possesses high electrical conductivity and very good mechanical properties. It is abrasion-resistant and hard. Thermal conductivity is also high.

The coating ensures effective corrosion protection, and at the same time constitutes a soldering aid. This is advantageous in particular with electrical or electronic components.

Theoretically, all metals and metal alloys with good electrical conductivity that are usual for electricalengineering applications can be used as the base material, copper and copper alloys being particularly preferred. Copper materials are characterized by their high electrical conductivity. For protection against corrosion and wear and in order to increase the surface hardness, it is usual to equip the copper material with a metal coating. In this connection, it is known in the existing art either to coat a strip made of copper material with tin by electroplating, or to apply tin or a tin-lead alloy onto a copper strip in a hot-dip bath.

In addition to copper, however, it is also possible to use tin bronze, brass, or low-alloyed copper alloys, for example $CuFe_2$, as the base material.

The tin film can be applied by hot-dipping methods and the silver film by electroplating. Furthermore, both the tin film and the silver film can be applied by electroplating. A further advantageous procedure is applying the tin film with the hot-dip method and the silver film subsequently by cathodic sputtering. It is also possible to apply both the tin film and the silver film by sputtering.

Especially by way of the combination of hot-dip tinning (hot tinning) of the initial strip at a film thickness of 0.5 $\mu$m to 10.0 $\mu$m, and subsequent silver application by electroplating, with a thickness for the applied silver film of between 0.1 $\mu$m and 3.5 $\mu$m, it is possible to manufacture a composite strip which meets stringent mechanical and physical requirements for the production of electrical contact elements. The tin-silver alloy coating also makes it possible to improve high-temperature strength under operating conditions, as compared to a conventional tin or tin-lead coating. The composite strip is easy to process by punching, cutting, bending, or deep drawing. It also possesses high strength with good spring properties. Electrical conductivity is high, and solder wettability is good. The applied coating is uniform in both structure and thickness, and is moreover pore-free. The tin-silver alloy coating reliably protects the base material from oxidation and corrosion.

A heat treatment, in particular in the form of a diffusion anneal, can additionally be provided. The heat treatment ensures reliable equalization of any concentration differences that may possibly still exist in the film structure of the applied coating. Heat treatment of the composite strip is preferably accomplished using a pass-through process, at a temperature between 140° C. and 180° C.

Prior to heat treatment, chemical passivation of the surface using ordinary inhibitors can be accomplished for protection against tarnishing.

It is theoretically also possible to perform a heat treatment on the tinned initial strip. Here again, a temperature range between 140 and 180° C. may be considered advantageous. Following heat treatment of the tinned initial strip, the silver coating is applied in a further production step.

For the tin film applied in the first coating step, both tin and a tin alloy with a lead content have proven successful. If the tin film is applied by hot-dipping, a tin alloy which contains 0.1 to 10 wt % of at least one of the elements of the group silver, aluminum, silicon, copper, magnesium, iron, nickel, manganese, zinc, zirconium, antimony, rhodium, palladium, and platinum has also proven to be advantageous. The remainder therein consists of tin, including unavoidable contaminants, and minor deoxidation and processing additives.

A cobalt-containing tin alloy with a cobalt concentration between 0.001 and 5 wt % can also be used. This tin alloy can also have 0.1 to 10 wt % bismuth, and/or 0.1 to 10 wt % indium, added to it.

The addition of cobalt promotes the formation of a fine-grained, uniform intermetallic phase between the base material and coating. The overall film hardness is also increased, and bendability is improved. In addition, shear strength can be improved and modulus of elasticity can be decreased. Bismuth and indium result in an additional increase in hardness via solid-solution hardening.

The present invention makes possible the manufacture of a coating made of a tin-silver alloy, of high quality in terms of its mechanical and physical properties, on the initial strip. The tin film is applied at a thickness of between 0.5 μm and 10.0 μm, preferably being between 0.8 μm and 3.0 μm. The subsequent silver film has a thickness of between 0.1 μm and 3.5 μm, preferably between 0.2 μm and 1.0 μm. These heterogeneous films then homogenize by diffusion into a tin-silver alloy film.

The composite strip according to the present invention is therefore particularly well-suited for the production of electrical contact components which are exposed to bending and shear stresses, for example those of electrical plug or clamp connectors. Connectors of this kind can be connected and disconnected repeatedly with no appreciable change in contact resistance.

In addition, the composite material manufactured according to the present invention can also be utilized for the production of electromechanical and electro-optical constituents or semiconductor constituents, and the like.

What is claimed is:

1. A method for manufacturing a metal composite strip for the production of electrical contact components, comprising the steps of applying a film of tin or a tin alloy to an initial strip of an electrically conductive base material having copper as at least a major constituent, subsequently depositing a silver film thereonto, and heat treating the composite strip.

2. The method as defined in claim 1, wherein the tin or tin alloy film is applied in the molten state, and the silver film is deposited by electroplating.

3. The method as defined in claim 2, wherein the tin or tin alloy film is applied at a thickness of between 0.5 μm and 10.0 μm, and the silver film is deposited at a thickness of between 0.1 μm and 3.5 μm.

4. The method as defined in claim 2, wherein the base material is copper or a copper alloy.

5. The method as defined in claim 1, wherein the heat treating is carried out by diffusion annealing.

6. The method as defined in claim 5, wherein the tin or tin alloy film is applied at a thickness of between 0.5 μμm and 10.0 μm, and the silver film is deposited at a thickness of between 0.1 μm and 3.5 μm.

7. The method as defined in claim 1, wherein the tin or tin alloy film is applied at a thickness of between 0.5 μm and 10.0 μm, and the silver film is deposited at a thickness of between 0.1 μm and 3.5 μm.

8. The method as defined in claim 7, wherein the base material is copper or a copper alloy.

9. The method as defined in claim 1, wherein the base material is copper or a copper alloy.

* * * * *